United States Patent [19]

Flock et al.

[11] Patent Number: 4,770,369

[45] Date of Patent: Sep. 13, 1988

[54] INFLATABLE MISSLE AIRFRAME SURFACES

[75] Inventors: Thomas G. Flock, Simi Valley; Norman E. Prevatte, Agoura, both of Calif.

[73] Assignee: Hughes Aircraft Company, Los Angeles, Calif.

[21] Appl. No.: 874,985

[22] Filed: Jun. 16, 1986

[51] Int. Cl.[4] ..... F42B 15/02

[52] U.S. Cl. ..... 244/3.1; 102/293

[58] Field of Search ..... 244/3.1; 102/293, 397, 102/490; 89/1.11

[56] References Cited

U.S. PATENT DOCUMENTS

| | | | |
|---|---|---|---|
| 2,377,839 | 6/1945 | Dake | 244/3.1 |
| 3,053,488 | 9/1962 | Cox | 244/130 |
| 3,086,467 | 4/1963 | Gallagher et al. | 244/3.1 |
| 3,710,716 | 1/1973 | Davis et al. | 102/7.4 |
| 4,166,597 | 9/1979 | Seifert et al. | 244/160 |
| 4,181,079 | 1/1980 | Klier et al. | 102/476 |
| 4,549,464 | 10/1985 | Hawkins et al. | 89/1.809 |

FOREIGN PATENT DOCUMENTS

| | | |
|---|---|---|
| 0157902 | 10/1985 | European Pat. Off. . |
| 3237485 | 4/1984 | Fed. Rep. of Germany . |
| 3347005 | 4/1985 | Fed. Rep. of Germany . |
| 3343267 | 6/1985 | Fed. Rep. of Germany . |
| 2367268 | 5/1978 | France . |

*Primary Examiner*—Charles T. Jordan

*Attorney, Agent, or Firm*—Robert A. Hays; Charles D. Brown; A. W. Karambelas

[57] ABSTRACT

This invention relates to an inflatable aerodynamic surface (14) particularly adapted for improving the aerodynamic smoothness of the forward end of a missile (10) of the type having a relatively blunt forward end with a centrally disposed extendible probe member (26). In accordance with this invention, a flexible membrane (36) is provided having a base edge (46) sealingly affixed to the forward edge of the missile casing and an apex (48) affixed to the forward end of the probe (26). The membrane (36) is inflated by a gas generator (42) to pressurize the inside of the membrane to define a smooth, nose-shaped aerodynamic frontal surface.

2 Claims, 2 Drawing Sheets

INFLATABLE MISSLE AIRFRAME SURFACES

BACKGROUND AND SUMMARY OF THE INVENTION

The invention relates to an improved frontal aerodynamic surface of a missile and particularly to one that is deployable from a retracted stowed position through gas pressure inflation to provide acceptable aerodynamic characteristics during flight while minimizing the overall size of the stored missile.

Modern tactical warfare techniques employ sophisticated guided missile systems. These missiles may be stored in the ammunition magazine of an aircraft, land vehicle, or other firing platform in preparation for use. In order to minimize the volume and size of the ammunition magazine of the firing platform, and/or to maximize the number of missiles which may be stored, it is desirable to minimize the overall length of the stored missiles. Minimization of the size of missiles becomes particularly significant when they are carried aboard aircraft since it is desirable to minimize the radar cross section of the aircraft.

A present design of a so-called TOW (tube launched, optically tracked, wire guided) missile employs a forwardly extending telescoping probe that becomes deployed immediately following launch. The probe contains a contact fuse which initiates explosion of the missile warhead at a desirable standoff distance to maximize damage to the target. Previous designs of TOW missiles have a relatively blunt frontal surface comprised of a generally flat forward end with a centrally disposed relatively small diameter projecting probe. Although these missiles operate satisfactorily, it is desirable to improve their aerodynamic characteristics to enable them to operate in higher velocity hypersonic or supersonic flow regimes. The present relatively blunt frontal configuration of such missiles has limited their velocity capabilities due to high aerodynamic drag. It is, accordingly, desirable to provide a smoothened aerodynamic nose surface for a missile having decreased drag characteristics for a missile of the type having a relatively blunt forward end.

SUMMARY OF THE INVENTION

The above desired feature is achieved in accordance with this invention through the use of an inflatable membrane which, when deployed, is generally cone shaped and supported at its base by the front edge of the missile. A gas generator device is employed to pressurize the inside of the inflatable membrane to a desired pressure. Once inflated, the membrane has a smooth aerodynamic profile, thereby reducing drag forces on the missile during flight.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
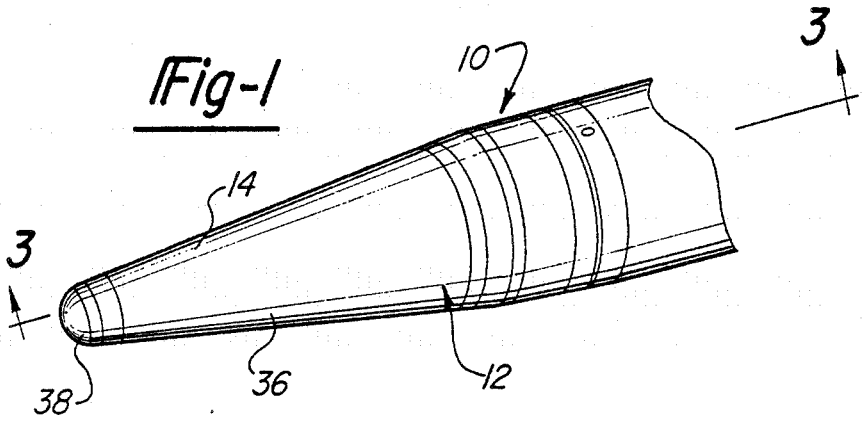
FIG. 1 is a pictorial view of the frontal nose section of a missile incorporating the inflatable frontal aerodynamic surface in accordance with this invention shown in the inflated configuration.
Figure 2:
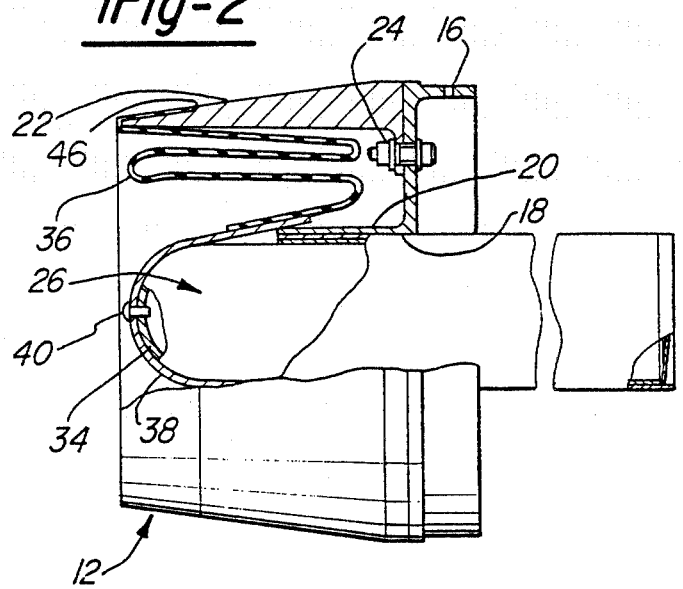
FIG. 2 is a longitudinal cross-sectional view of the nose section of a missile showing the frontal aerodynamic surface in accordance wth this invention and the extendible probe of the missile in their stored condition.
Figure 3:
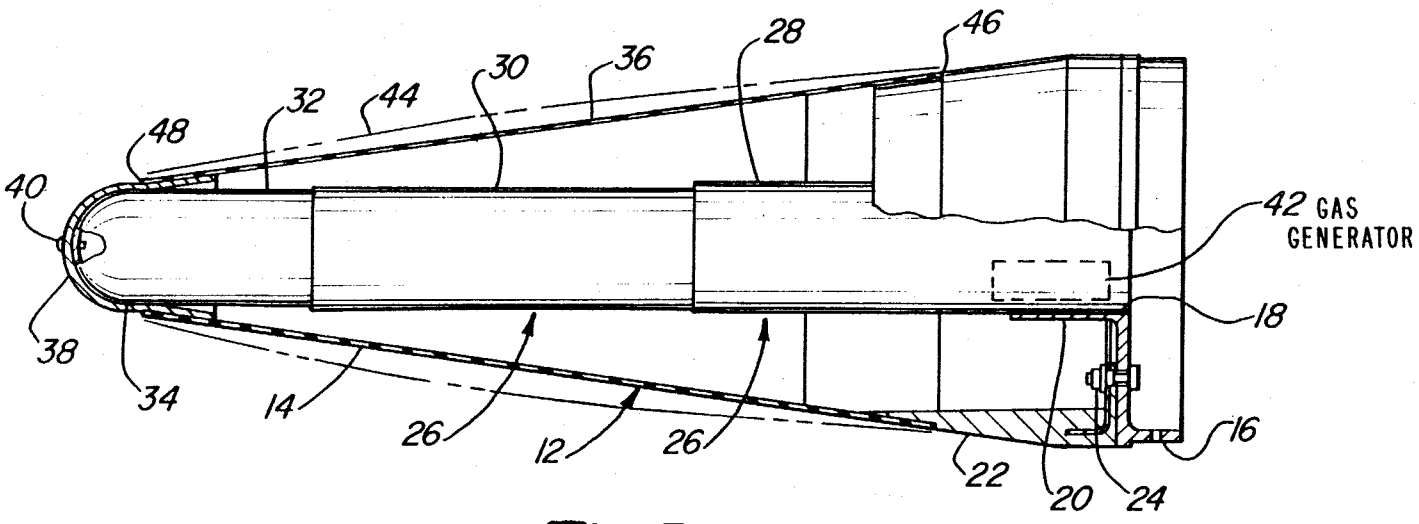
FIG. 3 is a longitudinal cross-sectional view of the nose section of a missile taken along line 3—3 of FIG. 1 showing the frontal aerodynamic surface and extendible probe in their deployed configuration.

FIG. 1 is a pictorial view of a missile 10 having a nose section 12 which incorporates an inflatable aerodynamic surface 14 in accordance with this invention. Missile 10 shown and described herein is a presently available TOW missile, although this invention is applicable to numerous other missile types. FIGS. 2 and 3 are longitudinal cross-sectional views of nose section 12 showing it in stored and deployed conditions, respectively. As shown in FIGS. 2 and 3, nose section 12 includes adapter 16 having a central bore 18 within an elongated forwardly projecting cylindrical portion 20. A forwardly extending skirt 22 is attached to adapter 16 by fasteners 24. Extendible probe assembly 26 is shown positioned within bore 18 and is comprised of three telescoping sections 28, 30, and 32. Probe assembly 26 contains a contact fuse (not shown) and is designed to telescope outwardly immediately following launch of missile 10. As previously described, probe assembly 26 provides the desired standoff detonation distance for the missile warhead to provide more effective target destruction. The forwardmost telescoping section 32 of probe assembly 26 defines a rounded frontal surface 34. As is evident from FIG. 3, extendible probe assembly 26, by itself, does not present a smooth frontal aerodynamic surface for missile 10. This lack of aerodynamic smoothness has limited the flight velocity capabilities of missile 10.

In accordance with this invention, missile 10 incorporates inflatable aerodynamic surface 14 as a means for enhancing the aerodynamic smoothness of the missile. FIG. 2 shows membrane 36 and probe assembly 26 in a stored configuration. Membrane 36 has its base edge 46 affixed to the forward edge of the missile casing defined by skirt 22. The apex 48 of membrane 36 is fastened to metal nose 38 which is affixed by fastener 40 to frontal surface 34 of telescoping section 32. As shown in FIG. 2, membrane 36 assumes a generally corrugated folded configuration in the annular space defined between the inside of skirt 22 and probe assembly 26. Membrane 36 may be formed from numerous materials. These inventors have found that neoprene coated Kevlar (Trademark) is an acceptable material for membrane 36.

As shown in FIG. 3, probe assembly 26 includes gas generator 42 which is activated upon extension of probe assembly 26 to discharge gas within the inside of membrane 36, thereby causing the membrane to become inflated to define a generally rigid surface. Gas generator 42 is designed to produce pressurization very rapidly so that the aerodynamic improvements are provided early in the flight sequence. Gas generation may be by a commercially available generator such as a commonly available pyrotechnic generator or could be a bottle of stored gas. A predetermined mass of gas-producing material is provided within generator 42 to pressurize the inside of membrane 36, preferably to a level of at least 5 psi above atmospheric pressure (i.e., gage pressure). Once pressurized, aerodynamic surface 14 assumes a generally conical, hard, durable, smooth exterior surface which improves the aerodynamic smoothness of missile 10 and thereby reduces drag forces during flight. Depending on the level of internal pressurization, membrane 36 may assume the position shown in FIG. 3 or be bulged outwardly, for example, to the position designated by phantom line 44. The configuration of aerodynamic surface 14 can also be easily changed through modifications to the shape of membrane 36 so that the missile can be tailored for the desired flight regime.

This invention could also be carried out in conjunction with missile designs which do not include probe assembly 26. For such an application, membrane 36 would be affixed to the missile only at its base and the remainder of the membrane would be self-supported through internal pressurization.

Although pressures extending from 5 psi above atmospheric pressure to three times atmospheric pressure have shown varying degrees of success, the optimum pressure may vary therefrom depending on the flight environment, membrane material, or other design considerations.

While the above descriptions constitute the preferred embodiments of the present invention, it will be appreciated that the invention is susceptible to modification, variation and change without departing from the proper scope and fair meaning of the accompanying claims.

What is claimed is:

1. An inflatable aerodynamic surface assembly adapted for use with a missile having a generally blunt forward end with a centrally projecting telescoping probe member extendible therefrom, comprising:

a skirt member extending forwardly from said forward end and defining a annular cavity surrounding said probe;

a nose section affixed to the forward end of said probe;

a generally conical-shaped membrane having a base edge sealingly attached to said skirt member and an apex portion affixed to said nose, and said membrane defining an enclosed chamber, said membrane being folded within said cavity when said probe is retracted; and gas generator means communicating with said enclosed chamber whereby activation of said gas generator means upon extension of said probe causes gases to pressurize said enclosed chamber, thereby inflating said membrane to define an aerodynamically smooth forward surface for said missile to reduce drag forces during flight.

2. An inflatable aerodynamic surface assembly according to claim 1 wherein said gas generator pressurizes said membrane to at least 5 pounds per square inch above atmospheric pressure.

* * * * *